US008729799B1

(12) United States Patent
Terdik et al.

(10) Patent No.: US 8,729,799 B1
(45) Date of Patent: May 20, 2014

(54) LOW-WORKFUNCTION PHOTOCATHODES BASED ON ACETYLIDE COMPOUNDS

(71) Applicants: Joseph Z. Terdik, Chicago, IL (US); Linda Spentzouris, Naperville, IL (US); Jeffrey H. Terry, Jr., Hammond, IN (US); Katherine C. Harkay, Lemont, IL (US); Karoly Nemeth, Darien (HU); George Srajer, Oak Park, IL (US)

(72) Inventors: Joseph Z. Terdik, Chicago, IL (US); Linda Spentzouris, Naperville, IL (US); Jeffrey H. Terry, Jr., Hammond, IN (US); Katherine C. Harkay, Lemont, IL (US); Karoly Nemeth, Darien (HU); George Srajer, Oak Park, IL (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 13/688,605

(22) Filed: Nov. 29, 2012

(51) Int. Cl.
*H01J 40/06* (2006.01)

(52) U.S. Cl.
USPC ..... 313/542; 313/543

(58) Field of Classification Search
USPC ..... 313/542–543
See application file for complete search history.

(56) References Cited

U.S. PATENT DOCUMENTS 3,814,993 A * 6/1974 Kennedy ..... 257/10
3,959,038 A * 5/1976 Gutierrez et al. ..... 257/10

* cited by examiner

*Primary Examiner* — Mary Ellen Bowman
(74) *Attorney, Agent, or Firm* — Joy Alwan; Brian J. Lally; John T. Lucas

(57) ABSTRACT

A low-workfunction photocathode includes a photoemissive material employed as a coating on the photocathode. The photoemissive material includes $A_nMC_2$, where A is a first metal element, the first element is an alkali metal, an alkali-earth element or the element Al; n is an integer that is 0, 1, 2, 3 or 4; M is a second metal element, the second metal element is a transition metal or a metal stand-in; and $C_2$ is the acetylide ion $C_2^{2-}$. The photoemissive material includes a crystalline structure or non-crystalline structure of rod-like or curvy 1-dimensional polymeric substructures with $MC_2$ repeating units embedded in a matrix of A.

20 Claims, 7 Drawing Sheets

LOW-WORKFUNCTION PHOTOCATHODES BASED ON ACETYLIDE COMPOUNDS

STATEMENT REGARDING FEDERALLY SPONSORED RESEARCH OR DEVELOPMENT

The United States Government has rights in this invention pursuant to Contract No. DE-AC02-06CH11357 between the U.S. Department of Energy (DOE) and University of Chicago, Argonne LLC.

CROSS-REFERENCE TO RELATED APPLICATION(S)

The present non-provisional patent application/patent claims the benefit of priority of U.S. Provisional Patent Application No. 61/564,941, filed on Nov. 30, 2011, and entitled "LOW-WORKFUNCTION PHOTOCATHODES BASED ON ACETYLIDE COMPOUNDS," the contents of which are incorporated in full by reference herein.

FIELD OF THE INVENTION

Generally, the field of art of the present disclosure pertains to electrodes, and more particularly, to low-workfunction photocathodes based on acetylide compounds for use in a variety of applications including, but not limited to, solar-cells, image-intensifier tubes, photomultipliers, field-emission displays, electron guns, free-electron lasers, and photosensors/detectors. Low workfunction photocathodes are especially useful in night vision devices which magnify or intensify radiation in the visible and infrared spectrum.

BACKGROUND OF THE INVENTION

Workfunction is the energy difference of the least bound electron of a solid and the electron's potential energy in vacuum outside the solid. The workfunction varies for different surfaces of solids. Photocathodes are devices that convert a fraction of the incident photons to emitted electrons. When a photocathode is struck by a photon, the absorbed energy causes electron emission due to the photoelectric effect. Low-workfunction photocathodes can be used in a variety of applications such as, without limitation, solar-cells, image-intensifier tubes, photomultipliers, field-emission displays, electron guns, free-electron lasers, and photosensors/detectors. Low-workfunction photocathodes are especially useful in night vision devices which magnify or intensify radiation in the visible and infrared spectrum. An exemplary low-workfunction photocathode is described in U.S. Pat. No. 3,821,778 to Kurtin which discloses an infrared low-workfunction photocathode for surveillance purposes constructed using a thin metal, $Cs_2O$ (cesium oxide) laminate.

In many photo-physical applications photoemissive materials are sought after that can turn a high fraction of the incident photons into emitted electrons, i.e. materials that have a high quantum-yield. Often, the quantum-yield of these materials depends heavily on the wavelength of incident photons. For many applications, ranging from electron-guns for synchrotrons and free-electron lasers to night vision devices, high quantum-yield photoemission using visible or infrared irradiation is desirable. In electron-guns of synchrotrons and free-electron lasers, emission in the visible range is advantageous for the improved control of the shape of the emitted electron bunch that is critical for time-resolved applications. In night-vision devices a very low flux of infrared photons has to be turned into emitted electrons with a high yield in order to obtain an image as sharp as possible. Therefore there is a quest for new and improved materials with optimized quantum-yield and low-workfunction.

One of the current best photoemissive materials is $Cs_2Te$ (cesium telluride). $Cs_2Te$ has been known since the 1950s and, conventionally, is widely used as a photoemissive material for photocathodes. $Cs_2Te$ is a high photo-yield compound. However, its workfunction is about 3 eV, which means only the photons in the ultraviolet spectrum cause electrons to be emitted. In electron-guns of synchrotrons and free-electron lasers, emission in the visible range is advantageous for the improved control of the shape of the emitted electron bunch that is critical for time-resolved applications. In addition to not being photoemissive in the visible spectrum, the surface of a photocathode made of $Cs_2Te$ oxidizes, reducing its photo-yield. Other photocathodes based on multi-alkali antimonide compounds, such as $K_2CsSb$ and $(Cs)Na_3KSb$, have a relatively short operational lifetime especially when used in radio-frequency accelerating cavities. It is desirable to have a photoemissive material made of a material that has a high photo-yield like $Cs_2Te$, but has a longer operational lifetime and a lower workfunction. Further, it is desirable to have a photoemissive material that functions in the visible light spectrum.

BRIEF SUMMARY OF THE INVENTION

In an exemplary embodiment, a photocathode includes an electrode; and a photoemissive material coating at least part of the electrode, wherein the photoemissive material includes $A_nMC_2$, where A is a first metal element; n is an integer from the group of integers consisting of 0, 1, 2, 3 and 4; M is a second metal element; and $C_2$ is triple bond carbon, in the form of $C_2^{2-}$ as an acetylide ion; wherein the photoemissive material includes a crystalline structure of rod-like or curvy 1-dimensional polymeric substructures with $MC_2$ repeating units embedded in a matrix of A; and wherein the photoemissive material includes a crystallographic surface for crystalline photoemissive materials, for non-crystalline photoemissive materials no crystal surface is included. The first element can be an alkali metal, an alkaline-earth element or the element Al. The second element can be a transition metal or a metal stand-in. The transition metal can be selected from any element in groups 3 through 12 inclusive on the Periodic Table of Elements (Sc, Ti, V, Cr, Mn, Fe, Co, Ni, Cu, Zn, Y, Zr, Nb, Mo, Tc, Ru, Rh, Pd, Ag, Cd, La and the lanthanides (57-70), Hf, Ta, W, Re, Os, Ir, Pt, Au, Hg, Ac and the actinides (89-112)).

The metal stand-in can be chosen from a group consisting of Tellurium (Te), Selenium (Se), Arsenic (As), Antimony (Sb), Bismuth (Bi), Carbon (C), Silicon (Si), Germanium (Ge), Tin (Sn), Lead (Pb), Boron (B), Aluminum (Al), Gallium (Ga), Indium (In), and Thallium (Tl). In some preferred embodiments, the second element, M, is Palladium (Pa), Platinum (Pt), Gold (Au), Silver (Ag), Copper (Cu), Nickel (Ni), Iron (Fe) or Te. The crystallographic surface can be (010). Optionally, the photoemissive material can be $Rb_2MC_2$; wherein the second element M can be chosen from a group of elements including the transition metals and Te. Alternatively, the photoemissive material can be $Cs_2MC_2$; wherein the second element M can be chosen from a group of elements including the transition metals and Te. Further, the photoemissive material can be $Cs_2TeC_2$. The crystallographic surface can be (001), (010), (110), or (100). Additionally, the photoemissive material can be $Cs_2PdC_2$. The photoemissive material can be $Na_2MC_2$; wherein the second element M can be chosen from a group of elements including the transition metals and Te. Optionally, the photoemissive material can be $Na_2PdC_2$. Alternatively, the photoemissive material can be $Na_2TeC_2$. The first metal can include Na, K, Rb, or Cs.

In another exemplary embodiment, a photoemissive material for coating at least part of an electrode includes $A_nMC_2$, where A is a first metal element; n is an integer from the group of integers consisting of 0, 1, 2, 3 and 4; M is a second metal element; and $C_2$ is triple bond carbon, in the form of $C_2^{2-}$ as an acetylide ion; wherein the photoemissive material includes a crystalline structure of rod-like or curvy 1-dimensional polymeric substructures with $MC_2$ repeating units embedded in a matrix of A; and wherein the photoemissive material includes a crystallographic surface for crystalline photoemissive materials.

In yet another exemplary embodiment, a low-workfunction photocathode includes an electrode; a photoemissive material coating at least part of the electrode, wherein the photoemissive material includes $Cs_2TeC_2$; wherein the photoemissive material includes a crystalline structure of rod-like 1-dimensional polymeric substructures with $TeC_2$ repeating units embedded in a matrix of Cs; and wherein the photoemissive material includes a crystallographic surface if the photoemissive material is crystalline.

BRIEF DESCRIPTION OF THE DRAWING(S)

Exemplary and non-limiting embodiments of the present disclosure are illustrated and described herein with reference to various drawings, in which like reference numbers denote like method steps and/or system components, respectively, and in which.

DETAILED DESCRIPTION OF THE INVENTION

Figure 1:
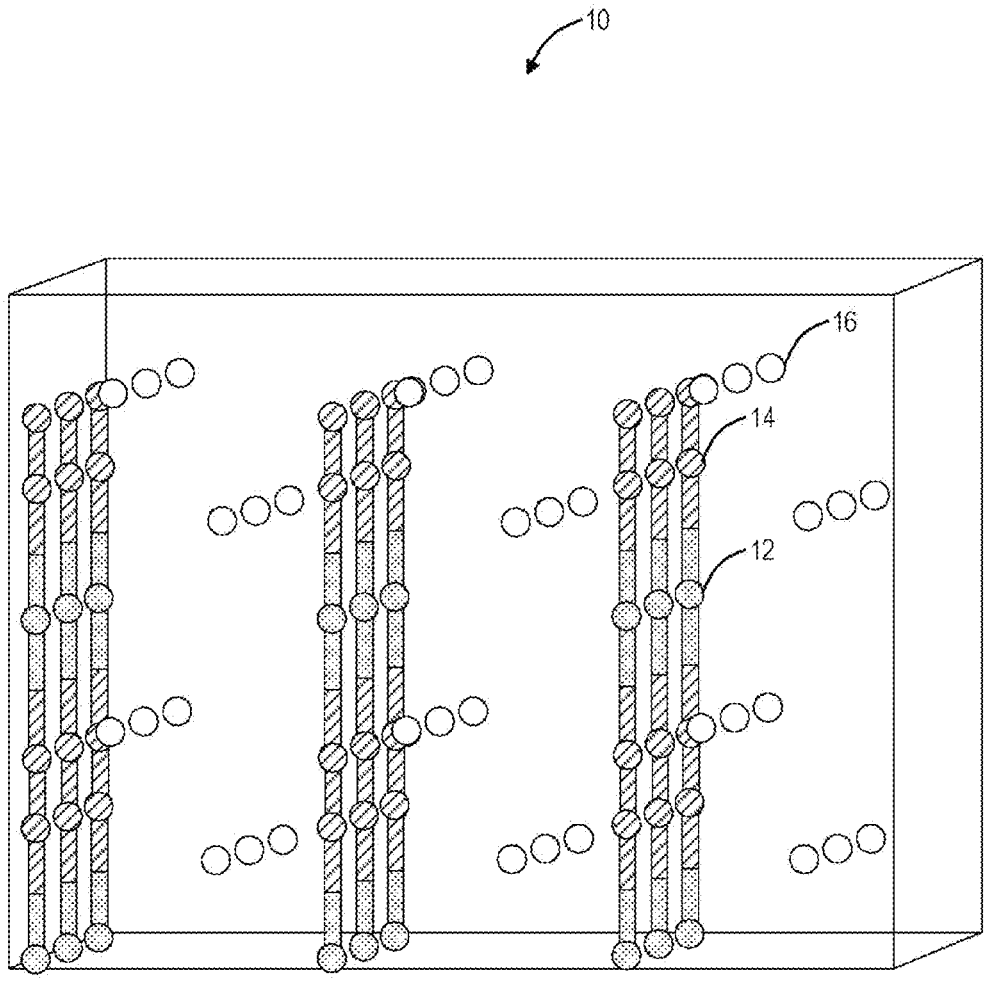
FIG. 1 is a side view of a 3×3×2 supercell of a hexagonal unit cell of $Cs_2TeC_2$.

In various exemplary embodiments, low-workfunction photocathodes are described for use in a variety of applications including, but not limited to, solar-cells, image-intensifier tubes, photomultipliers, field-emission displays, electron guns, free-electron lasers, and photosensors/detectors. Low workfunction photocathodes are especially useful in night vision devices which magnify or intensify radiation in the visible and infrared spectrum. The low-workfunction photocathodes can magnify and intensify images in infrared light, visible light and ultraviolet light, depending on which crystal cleavage plane surface is being used if the photoemissive material is crystalline.

In an exemplary embodiment, a low-workfunction photocathode includes an electrode with a photoemissive material coating at least part of the electrode. The photoemissive material includes $A_nMC_2$, where A is a first metal element (preferably an alkali metal); n is an integer that is 0, 1, 2, 3 or 4; M is a second metal element (preferably a transition metal or a stand-in metal); and $C_2$ is the acetylide ion $C_2^{2-}$. The material of the photoemissive material includes a crystalline structure or non-crystalline structure including a rod-like 1-dimensional polymeric substructures with $MC_2$ repeating units embedded in a matrix of A. The material of the crystalline photoemissive compound has crystallographic surfaces such as 001, 010, 100, and 110, typically within a hexagonal packing of the rod-like or curvy substructures. In an exemplary embodiment the photoemissive material is $Cs_2TeC_2$ which has a low-workfunction of about 1.2-2.4 eV for the (010) surface (note that the (010) and (100)) surfaces planes are identical. Photoemissive properties of ternary acetylides have been computationally explored and described in Physical Review B 86, 035142 (2012), "Anomalous work function anisotropy in ternary acetylides" by Joseph Z. Terdik, Karoly Nemeth, Katherine C. Harkay, Jeffrey H. Terry Jr. Linda Spentzouris, Daniel Velazquez, Richard Rosenberg, and George Srajer, and are hereby fully incorporated by reference.

Despite the limitations described herein with respect to $Cs_2Te$, $Cs_2Te$ still has 20-30 time longer operational lifetime than competing multi-alkali antimonide photocathodes, such as $K_2CsSb$ and $(Cs)Na_3KSb$, especially when operated in radio-frequency accelerating cavities. In the process of attempting to design modifications of $Cs_2Te$ with lowered workfunction and preserved high quantum-yield, the effects of small gas molecules on $Cs_2Te$ surfaces were considered. Such effects have been previously studied by di Bona et al. J. Appl. Phys. 80, 3024 (1996), using small gas molecules occurring in vacuum, such as $O_2$, $N_2$, $CO_2$, CO and $CH_4$. The effect of another small gas molecule, acetylene ($C_2H_2$) had not been considered yet, despite the potentially interesting reactions between $C_2H_2$ and $Cs_2Te$. $C_2H_2$ is an acidic compound and prefers to decompose to acetylide anion $C_2^{2-}$ and to $2H^+$ in the presence of a base.

Figure 2:
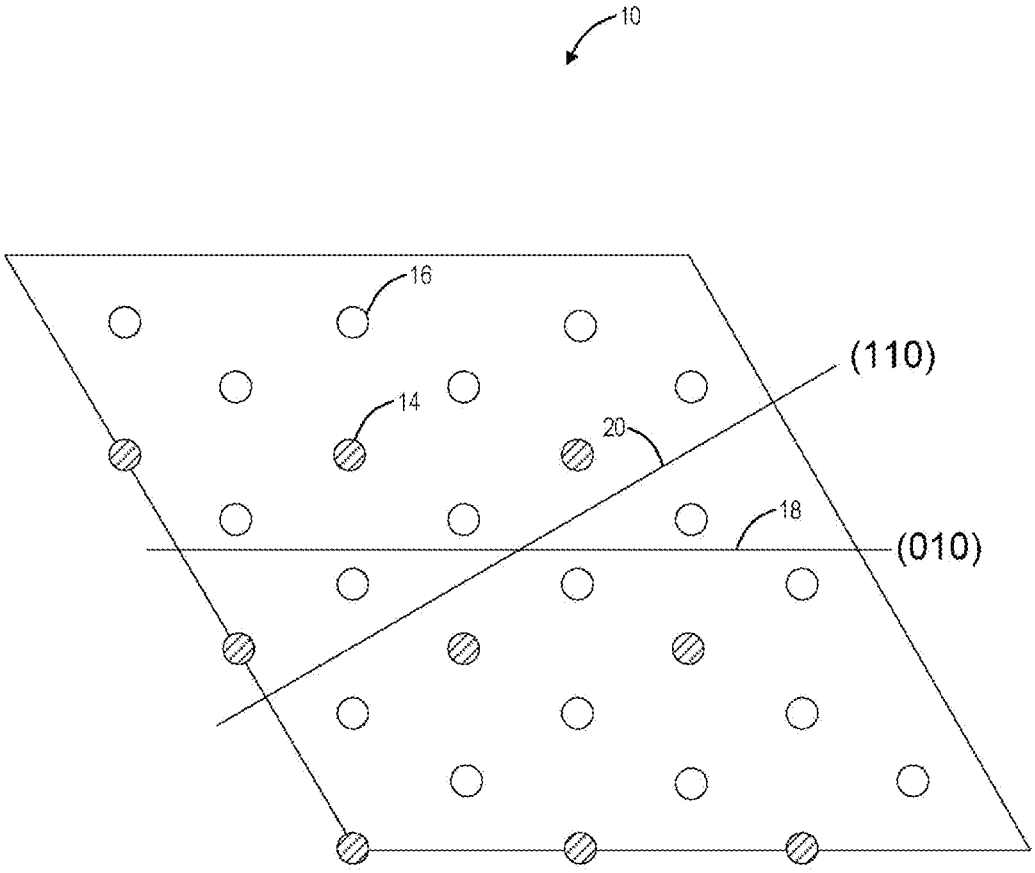
FIG. 2 is a top view of the 3×3×2 supercell of FIG. 1.

Based on the acidic character of $C_2H_2$, one might investigate the working hypothesis that the reaction of $$Cs_2Te(cr)+C_2H_2(g)\rightarrow Cs_2TeC_2(cr)+H_2(g) \quad (1)$$

would produce a ternary acetylide $Cs_2TeC_2$ whereby the oxidation number of Te would change from −2 to 0 and that of H from +1 to 0, with (cr) denoting crystal and (g) gas phase. Interestingly, a class of ternary (i.e. three-component) acetylides exists, involving already synthesized members with the general formula of $A_2MC_2$ with A∈[Na, K, Rb, Cs] and M∈[Pd, Pt], and the oxidation number of the metal M in them is zero. All existing compounds of the $A_2MC_2$ formula have a hexagonal unit cell with rod-like $[MC_2]\infty$ substructures running parallel with the main crystallographic axis, and very similar distribution of alkali atoms around the $[MC_2]\infty$ rods, just as shown in FIGS. 1 and 2. All known $A_2MC_2$ materials are colored semiconductors with 2.1-2.8 eV direct band-gaps. The other class of ternary acetylides with synthesized members contains only a single alkali atom and has the formula of $AMC_2$[6] with the $[MC_2]\infty$ rods adopting 3 different kinds of rod-packings.

FIG. 1 is a side-view of a 3×3×2 supercell 10 of a hexagonal unit cell of $Cs_2TeC_2$. Spheres 12 denote Te, spheres 14 denote C, and spheres 16 denote Cs. Notice the $[TeC_2]\infty$ rods. FIG. 2 is a top-down view of the 3×3×2 supercell 10. The $[TeC_2]\infty$ rod-like substructures are running perpendicularly to the plane viewed. A line 18 indicates the energetically preferred cleavage-plane for the (010) surface running between two layers of Cs atoms, parallel with the rods, while a line 20 refers to the preferred cleavage-plane for the (110) surface that involves $[TeC_2]\infty$ rods directly exposed on the surface. Note that the (010) and (100) planes are identical.

Adopting the structure of the unit cell of $Na_2PdC_2$ and substituting Na with Cs and Pd with Te a full crystal structure (lattice parameters and atomic fractional coordinates) optimization has been carried out using Density Functional Theory (DFT), without any symmetry and point group constraints on the translational unit cell. The PWSCF-code8, plane-wave representation of wave-functions with 80 Rydbergs wavefunction-cutoff, the PBE exchange-correlation functional were used in conjunction with norm-conserving pseudopotentials for Cs, Na and Te and ultrasoft ones for the other elements as available in the PWSCF distribution. The k-space grids were at least 6×6×6 large for optimizations, the residual forces on fractional coordinates were less than 4×10-4 Ry/au, residual pressure on the unit cell less than 1 kbar. For validation of the DFT-based methodology, known structural parameters and workfunctions of compounds with similar composition were calculated, achieving good agreement between computed and experimental values as indicated in Tables I, II and III. Note that in some cases, like $Na_2PdC_2$ and $Cs_2PdC_2$ the difference between calculated and experimental a and b lattice parameters (rod distances) was about 3-3.5%, significantly larger than that for the c lattice parameter (<1%), which has been accepted on the basis that the inter-rod interactions are more difficult to accurately predict, similarly to general intermolecular interactions.

Figure 3:
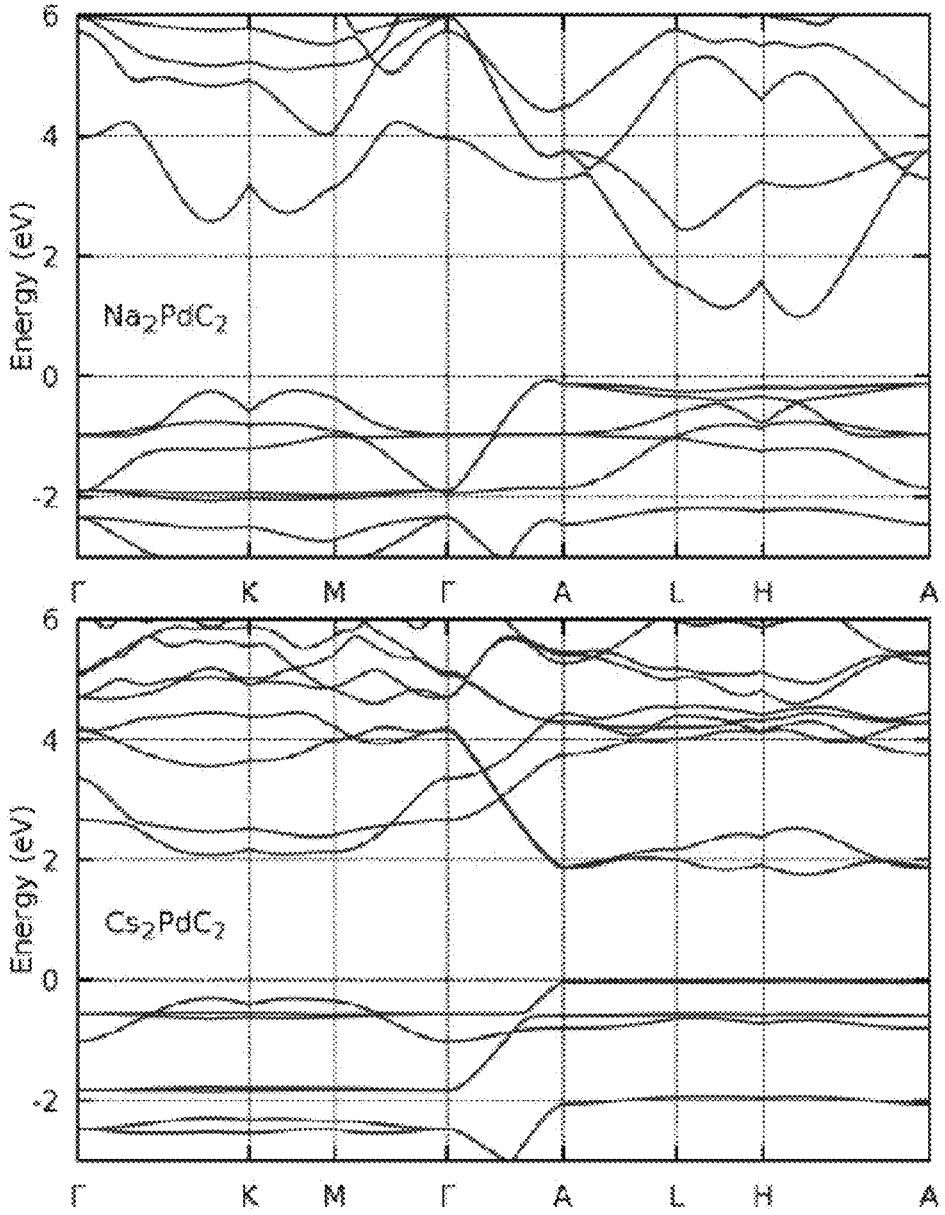
FIG. 3 is a graph of bandstructures of $Na_2PdC_2$ and $Cs_2PdC_2$ using the PBE[9] exchange-correlation functional.
Figure 4:
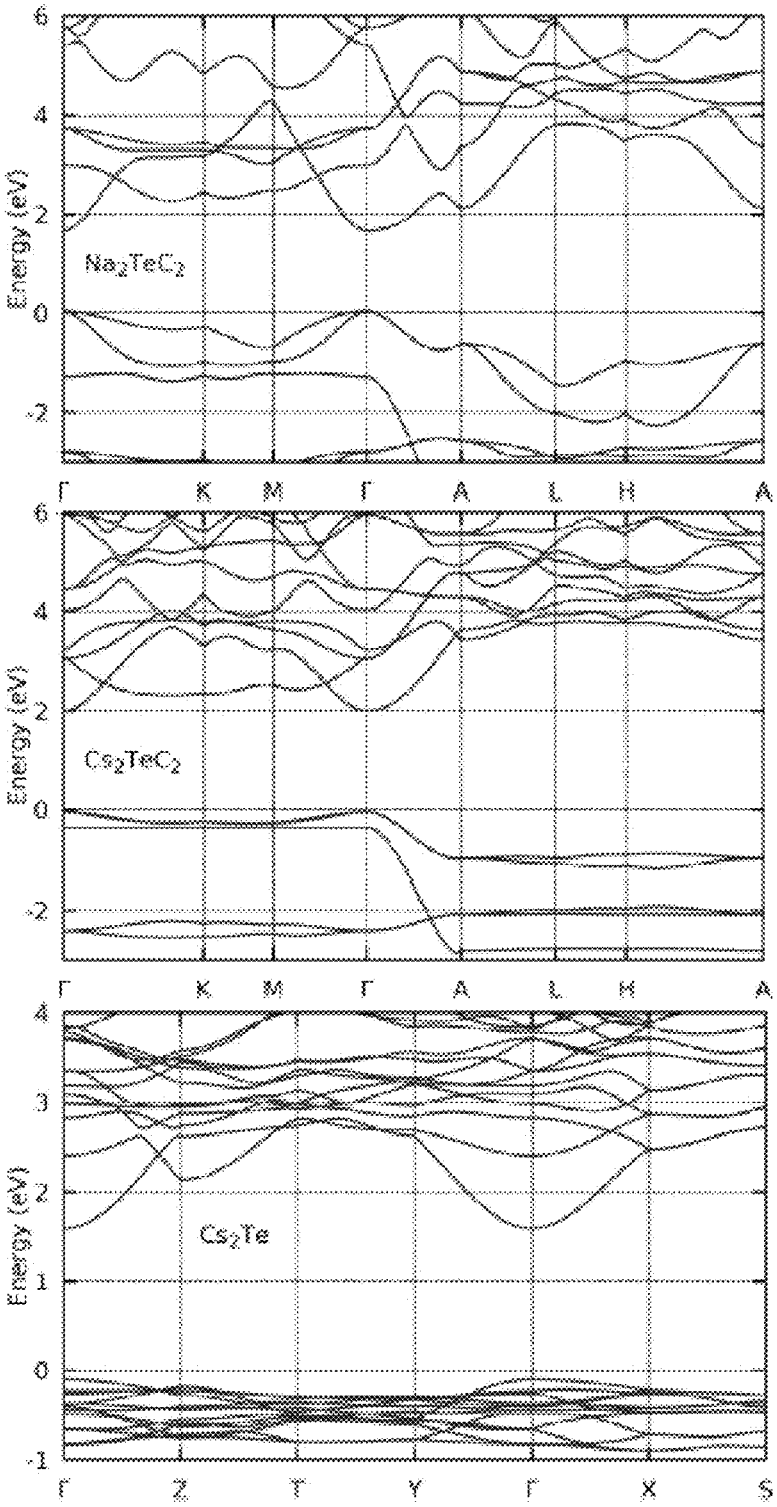
FIG. 4 is a graph of bandstructures of $Na_2TeC_2$, $Cs_2TeC_2$ and $Cs_2Te$, using the PBE[9] exchange-correlation functional.

The workfunction calculations were based on slabs of at least 30 Å width separated by vacuum layers up to 120 Å following the methodology of C. J. Fall et. al, J. Phys.: Cond. Mat. 11, 2689 (1999). For additional validation of the use of the PBE functional here, the direct bandgaps of $Na_2PdC_2$ and $Cs_2PdC_2$ were compared to experimental data. Experimental direct bandgaps of $Na_2PdC_2$, $K_2PdC_2$ and $Rb_2PdC_2$ are at 2.09, 2.55 and 2.77 eV, that of $Cs_2PdC_2$ is estimated to be slightly greater than that of $Rb_2PdC_2$. The PBE calculations predict the lowest energy direct transitions between 1.2-1.8 eV for $Na_2PdC_2$ near the H point) and 1.7-2.6 eV for $Cs_2PdC_2$ (near the H and K points), as shown in FIG. 3. The overall characteristics of these bands are similar to those calculated previously for ternary acetylides. FIG. 3 includes the bandstructures of $Na_2PdC_2$ and $Cs_2PdC_2$ using the PBE exchange-correlation functional of J. P. Perdew et. al, Phys. Rev. Lett. 77, 3865 (1996). The k-space was 14×14×14 large. The Fermi energy is at 0 eV. Flat bands are characteristic for ternary acetylides. Band gaps of bulk $Cs_2Te$, $Cs_2TeC_2$ and $Na_2TeC_2$ have been predicted to be between 1.8-2.0 eV, using the PBE functional (FIG. 4). FIG. 4 includes the bandstructures of $Na_2TeC_2$, $Cs_2TeC_2$ and $Cs_2Te$, using the PBE exchange-correlation functional of J. P. Perdew et. al, Phys. Rev. Lett. 77, 3865 (1996). The k-space was 14×14×14 large. The Fermi energy is at 0 eV.

Figure 5:
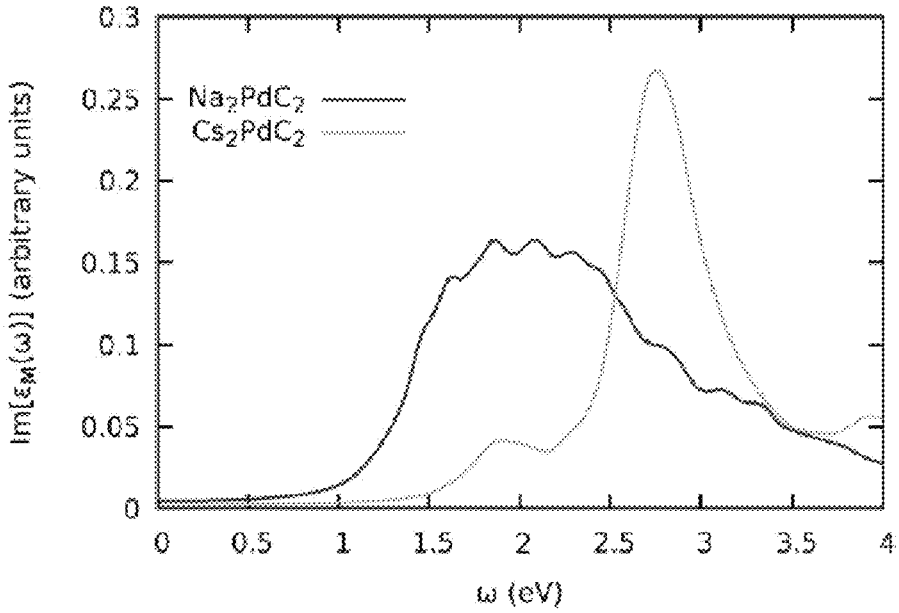
FIG. 5 is a graph of optical absorption spectra of bulk $Na_2PdC_2$ and $Cs_2PdC_2$ from the imaginary part of the macroscopic dielectric function $\in_M(\omega)$.
Figure 6:
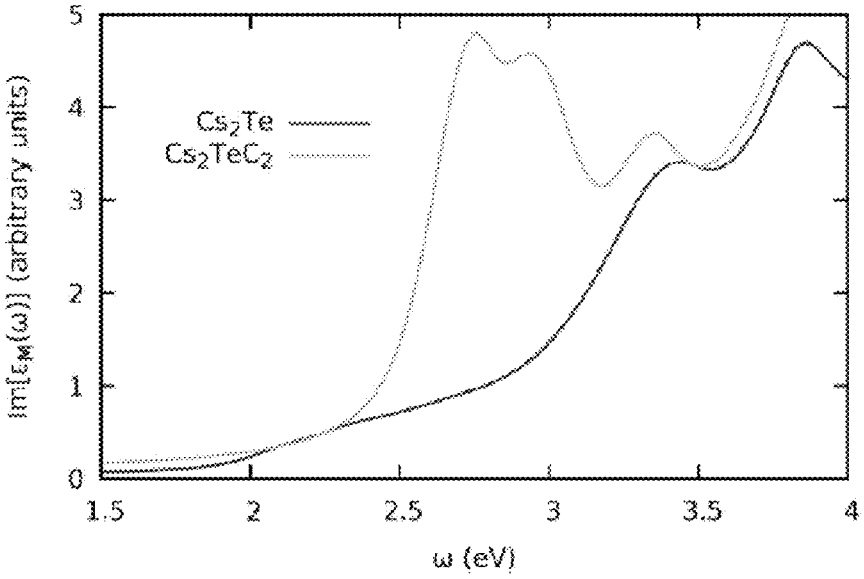
FIG. 6 is a graph of optical absorption spectra of bulk $Cs_2Te$ and $Cs_2TeC_2$ from the imaginary part of the macroscopic dielectric function $\in_M(\omega)$.
Figure 7:
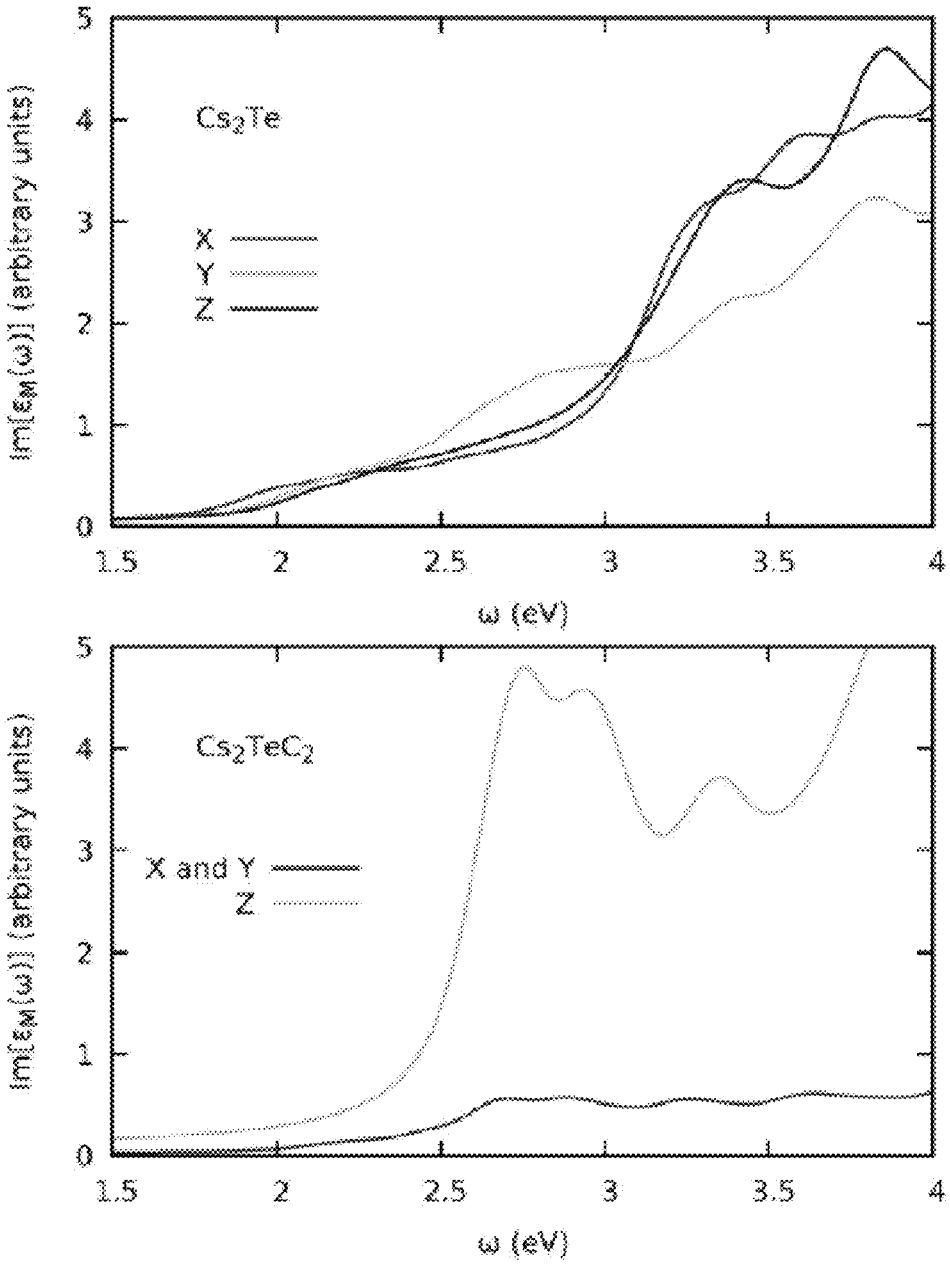
FIG. 7 is a graph of dependence of the optical absorption spectra of bulk $Cs_2Te$ and $Cs_2TeC_2$ on the polarization of the incident light.

The optical absorption spectra of some ternary acetylides and $Cs_2Te$ is also calculated (FIGS. 5 and 6) in the Random Phase Approximation (RPA) using the YAMBO-code (A. Marini et. al, Comp. Phys. Comm. 180, 1392 (2009), www.yambo-code.org). All optical absorption calculations have been performed with a resolution of k<0.1 Å-1, and a Gaussian broadening of 0.03 Ry. FIG. 5 is the optical absorption spectra of bulk $Na_2PdC_2$ and $Cs_2PdC_2$ from the imaginary part of the macroscopic dielectric function $\in_M(\omega)$. Only the G=0 planewaves were used to calculate intensities in the RPA approximation. The polarization vector of the light is along the main crystallographic axis (along the $[PdC_2]_\infty$ chains). FIG. 6 is optical absorption spectra of bulk $Cs_2Te$ and $Cs_2TeC_2$ from the imaginary part of the macroscopic dielectric function $\in_M(\omega)$. The 4000 lowest energy planewaves were used to calculate intensities in the RPA approximation. The polarization vector of the light is along the main crystallographic axis (along the $[TeC_2]_\infty$ chains and the c-axis of $Cs_2Te$). Note that for maximum absorption the polarization of the light was parallel with rods in the ternary acetylides and parallel with the crystallographic c-axis in $Cs_2Te$ (see FIG. 7). Due to the lack of norm-conserving pseudopotential for Pd, optical absorption spectra of $Na_2PdC_2$ and $Cs_2PdC_2$ could not be calculated. In order to associate these gaps with transition probabilities, a crude approximation of these spectra using only planewaves with G=0 wave-vectors was attempted. It indicates absorption maxima at 1.8 and 2.6 eV for $Na_2PdC_2$ and $Cs_2PdC_2$, respectively (FIG. 5). Unexpectedly, PBE calculations at the same geometries result in about 1.0 eV larger gaps than the experimental ones.

The optimization reveals that $Cs_2TeC_2$ has a very similar structure to other compounds of the $A_2MC_2$ class. The DFT calculations predict that the electronic energy change in Eq. 1 is E=+1.1 eV per $Cs_2TeC_2$ unit, while that in the alternative reaction of $$Cs_2C_2(cr)+Te(cr)\rightarrow Cs_2TeC_2(cr) \quad (2)$$

is ΔE=−0.95 eV, indicating the stability of the $Cs_2TeC_2$ crystal and an alternative synthesis route. In fact the synthesis in Eq. 2 is analogous to that of already existing $A_2MC_2$ compounds. The predicted stability of a ternary acetylide with metalloid element (Te) instead of a transition metal for M in the $A_2MC_2$ formula is indicative of potential extension of this class of materials with metalloids, while preserving the peculiar rod-like $[MC_2]_\infty$ substructures. The analysis at this point cannot exclude the existence of other structures for $Cs_2TeC_2$. It was attempted to start the optimization of a 5 atomic unit cell of $Cs_2TeC_2$ from several randomly chosen initial lattice parameters and atomic positions. In all cases the formation of $[TeC_2]_\infty$ rods was evident after a few hundred steps. It is relied upon that the fact that $A_2MC_2$ compounds have been found only with hexagonal rod packing so far. Also, the structure of h-$Cs_2C_2$ already contains the hexagonal rod-packing of the $C_2$ units leaving place for intercalatable atoms, such as Te, or transition metals, between neighboring $C_2$-s along a rod.

One should also note that the linear chains of carbon atoms, $[C_2]_\infty$ with alternating C—C and CC bonds (polycarbyne) or with uniform C═C bonds (cumulenes, polyallenes), have long been a subject of theoretical and materials science interest (see S. Roth and D. Carroll, *One Dimensional Metals: conjugated polymers, organic crystals, carbon nanotubes* (Wiley-VCH, Weinheim, 2004) and F. Diederich, in *Modern Acetylene Chemistry*, edited by P. J. Stang and F. Diederich (VCH, Weinheim, 1995)). However, unlike their hydrogenated analogue, $[C_2H_2]_\infty$ polyacetylene, containing alternating C—C and C═C bonds, famous for high electrical conductivity on the order of that of silver when doped (see C. K. Chiang et. al, J. Am. Chem. Soc. 100, 1013 (1978) and the Nobel Prize in Chemistry, 2000, to A. J. Heeger, A. G. MacDiamid and H. Shirakawa.), $[C_2]_\infty$ could not have been synthesized until a decade ago, proving the existence of $[C_2]_n$ with n∈[200,300]. Interestingly, the efficient synthesis of $[C_2]_n$ involves copper-acetylides. Furthermore, copper-acetylides can also be used as the starting material for their synthesis (see F. Cataldo, Polymer International 48, 15 (1999)), pointing to the intimate relationship of the rod-like $[MC_2]_\infty$ substructures in ternary-acetylides $A_2MC_2$ and $AMC_2$ to linear carbon chains. Copper-acetylide molecules are also studied for their self assembly into extremely thin nanowires in K. Judai et. al, Adv. Mater. 18, 2842 (2006). It is also important to note that while some transition-metal acetylides are known explosives, their alkalinated versions such as $AMC_2$ and $A_2MC_2$ are not explosive at all and can survive heating up to 500-600° C. and grinding (H. Billetter et. al, Z. Anorg. Allg. Chem. 636, 1834 (2010) and R. Buschbeck et. al, Coordination Chemistry Reviews 255, 241 (2011).

Figure 8:
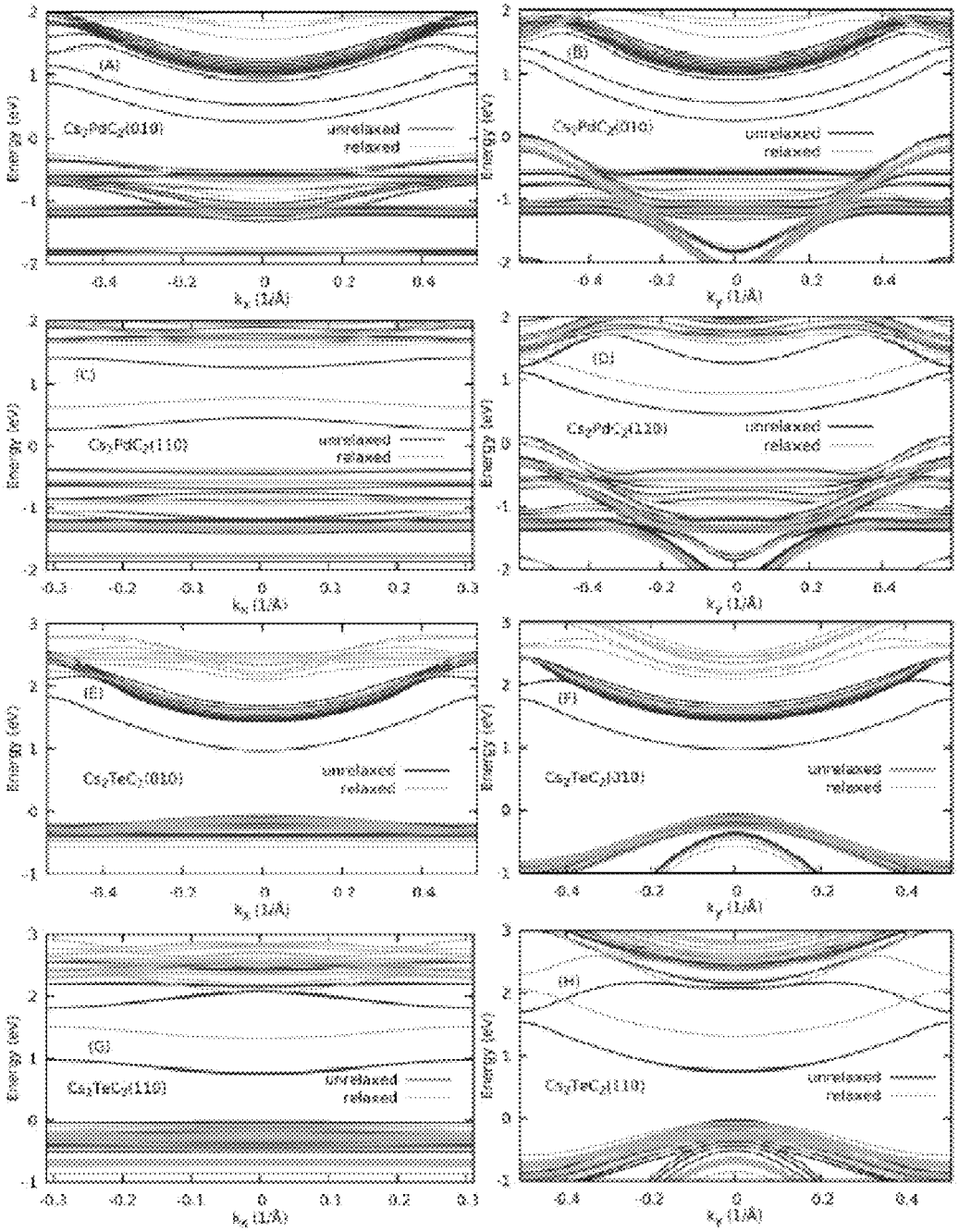
FIG. 8 is graphs of electronic bands of the slabs of the (010) and (110) surfaces of $Cs_2PdC_2$ and $Cs_2TeCs_2$ along the two orthogonal reciprocal surface lattice vectors $k_x$ (panels A, C, E and G) and $k_y$ (panels B, D, F and H).

As it is indicated in Table IV, the workfunctions of different surfaces of $Cs_2TeC_2$ have largely different values. Concerning the three most important surfaces (FIG. 2), there is a 1 eV decrease as one goes from (001) through (110) to (010) in each step, with workfunctions of 3.71, 2.77 and 1.71 eV, and surface energies of 0.022, 0.020 and 0.013 eV/Å$^2$, respectively, for the unrelaxed surfaces. Relaxed surfaces have somewhat greater workfunction values, but still allowing for emission in the visible spectrum. Relaxation of the surface layers greatly influences the unoccupied bands, while the occupied ones change significantly less, as indicated in FIG. 8. Specifically, FIG. 8 is graphs of electronic bands of the slabs of the (010) and (110) surfaces of $Cs_2PdC_2$ and $Cs_2TeC_2$ along the two orthogonal reciprocal surface lattice vectors $k_x$ (panels A, C, E and G) and $k_y$ (panels B, D, F and H). The $[MC2]_\infty$ rods are parallel with the y direction for all (010) and (110) surface slabs. Bands at both relaxed (light gray) and unrelaxed (dark gray) slabs are shown. The Fermi energy is at 0. Also note that the total energy differences between relaxed and unrelaxed surfaces are small, for example they are only 0.3 eV for a whole $Cs_2TeC_2$(010) slab, i.e. about 0.01 eV/atom in the top surface layers which allows for thermal population of a great variety of surface structures at room temperature.

In $Cs_2TeC_2$(010) and $Na_2TeC_2$(010) surface relaxations may break the $[TeC_2]_\infty$ rods, while the rods stay intact in Pd (or other transition metal) based ternary acetylides. In $Cs_2PdC_2$(010) and $Na_2PdC_2$(010) the rods provide quasi rails along which Cs-s and Na-s can easily move due to thermal motion. This is also in accordance with the anomalous broadening of peaks in the x-ray powder spectra of ternary acetylides (see U. Ruschewitz, Z. Anorg. Allg. Chem. 632, 705 (2006)). Such an anomalous anisotropy of workfunction values is highly unusual and represents a broad range of workfunction choice within a single material, allowing for emission in ultraviolet, visible and near infrared radiation. The lowest surface cleavage energy $Cs_2TeC_2$ surface, (010), has a similar surface energy as those of $Cs_2Te$ surfaces; it is, however, associated with a much lower (by 1.3 eV) workfunction. The highly anisotropic properties of $Cs_2TeC_2$ are due to the relative orientation of the rod-like $[TeC_2]_\infty$ substructures and the surfaces. Surface energies reveal that cutting the rods by cleaving the M—C bonds ((001) surface) is energetically disadvantageous, and it is also disadvantageous to allow for rods to be directly exposed on the surface ((110) surface), while cleavage between Cs atoms with rods embedded under the surface is the most energetically favorable construct ((010) surface). Note, despite not going beyond a single surface unit to study the energetics of surfaces, numerous variants of surface coverages may exist at different temperatures that expose or cover rods by Cs on the surface. The sticking of Cs to these surfaces may be a similarly important issue here as in the case of cesiated III/V semiconductor surfaces (e.g. GaAs) (see M. Besancon et. al, Surface Science 236, 23 (1990)). As the rods are twice negatively charged per $MC_2$ unit, it is expected that the sticking of Cs cations would be relatively strong.

High anisotropy can be observed in $Na_2PdC_2$, $Na_2TeC_2$ and $Cs_2PdC_2$ as well, with somewhat smaller, 1.1-1.6 eV difference between the external surfaces. The type of the alkali atom very sensitively influences the workfunctions: substituting Na with Cs results in more than 1 eV reduction of the workfunction on the (110) and (010) surfaces independently from the type of the $[MC_2]_\infty$ chain, even though the M—C bonding in these chains is very different. One has to note that the Pd—C distance is significantly shorter than the Te—C in these compounds, 2.01 Å vs. 2.45 Å, respectively, while Te and Pd have very similar covalent radii of 1.4 Å (C. Beatriz et. al, Dalton Trans. 21, 2832 (2008)). The (001) surface energies also indicate a much stronger Pd—C bond than Te—C one. While there is σ-bond in both Pd—C and Te—C links between the $2sp^1$ hybrid orbital of the C atom and the $5sp^1$ hybrids of Pd and Te (all oriented along the M-C—C line) the Pd—C link is further strengthened by strong back-donation of Pd 4d shell electrons to the antibonding π-orbitals of the $C_2^{2-}$ ions, also associated with lengthening of the C—C bond (H. Billetter et. al, Z. Anorg. Allg. Chem. 636, 1834 (2010)). Also note that $Cs_2Te$ (and also $Cs_2TeC_2$) has the advantage over the formerly mentioned multi-alkali-antimonides that Cs is better bound in them allowing for longer operational lifetime (D. H. Dowell et. al, Nuclear Instruments and Methods in Physics Research A 622, 685 (2010)). Another interesting comparison can be made to amorphous cesiated carbon films obtained from the co-deposition of high-energy negatively charged carbon ions and Cs on silicon substrates, as the low, 1.1 eV workfunction in them might be associated with increased acetylide ion concentration. However, there is no available data of how well Cs is bound in these systems (Y. W. Ko and S. I. Kim, J. Appl. Phys. 82, 2631 (1997)).

In order to estimate the quantum-yield of $Cs_2TeC_2$ relative to $Cs_2Te$, their optical absorption spectra (FIG. 6) are calculated using the lowest energy 4000 planewaves at which the spectrum becomes saturated against further increase of the number of planewaves. The spectra indicate that acetylation of $Cs_2Te$ shifts its first absorption peak in the visible region to 2.7 eV, while preserving the same absorption intensity. This comparison suggests that $Cs_2TeC_2$ may have similarly high quantum efficiency as that of $Cs_2Te$, however, even for visible and potentially also for near infrared photons. The bandgaps at the Γ point of $Cs_2TeC_2$ surfaces (see Table IV) also support that photon-energies near the workfunction are sufficient to induce emission in this material. An interesting characteristics of ternary acetylides is the extensive presence of flat bands (see FIGS. 3 and 4). While there are some flat band parts in $Cs_2Te$ as well, such a feature is much more characteristic for ternary acetylides. Flat bands greatly increase the density of states for some spectral regions thus they contribute to increased absorption of light. Interestingly, not only the workfunctions of these materials show high anisotropy, but also their optical absorption (see FIG. 7). The optical absorption is almost a magnitude greater when the light's polarization vector is parallel with the $[MC_2]_\infty$ rods. This property can allow for example for the generation of pulsed electron beams when these surfaces are illuminated by circularly polarized light. Several other optical applications can be envisioned based on the anisotropy of optical absorption in ternary acetylides, such as polar-filters and optical switching elements.

It is also important to call attention to the rest of the ternary acetylides as valuable photoemissive materials. For example the already synthesized $Cs_2PdC_2$(010) (U. Ruschewitz, Z. Anorg. Allg. Chem. 627, 1231 (2001)) material is predicted here to have a very low 1.33-2.03 eV workfunction even smaller than that of $Cs_2TeC_2$(010) and a similar density of states.

While it may be difficult to lower the workfunction into the infrared spectral domain (below 1.5 eV), multiphoton absorption of infrared light may still provide a way to photo-emission in this domain as well. Strong multiphoton absorption of organic and inorganic compounds with acetylide units is well known (Guang S. He et. al, Chem. Rev. 108, 1245 (2008)), for example in platinum acetylides (K. Sonogashira et. al, J. Organomet. Chem. 145, 101 (1978)), the analogy suggests that multiphoton absorption may be strong in ternary acetylides as well. Multiphoton absorption happens via simultaneous absorption of multiple photons without the need of real intermediate states as opposed to cascaded multiple step one-photon absorptions. These latter ones are also possible in ternary acetylides as there are surface states 1-1.5 eV above the Fermi level as indicated in FIG. 8.

Emission from $A_2MC_2$(001) surfaces (rods perpendicular to surface) may especially be suitable for generating low transverse emittance electron beams (K. Nemeth et. al, Phys. Rev. Lett. 104, 046801 (2010)) as excited electrons are expected to be guided along the $[MC2]_\infty$ rods while traveling from inside the bulk of the cathode towards the surface whereby not being scattered side-wise, analogously to needle-array cathodes of field emission (R. Ganter et. al, Phys. Rev. Lett. 100, 064801 (2008)).

| Compound, space-group & reference | Lattice Parameters (Å) EXPT A | b | c | DFT a | B | c |
|---|---|---|---|---|---|---|
| Cs ($Im\bar{3}m$) | 6.067 | 6.067 | 6.067 | 6.067 | 6.067 | 6.067 |
| Te ($P3_121$) | 4.526 | 4.526 | 5.920 | 4.458 | 4.458 | 5.925 |
| $Cs_2Te$ (Pnma | 9.512 | 5.838 | 11.748 | 9.558 | 5.832 | 11.750 |
| C ($Fd\bar{3}m$) | 3.567 | 3.567 | 3.567 | 3.573 | 3.573 | 3.573 |
| $Na_2C_2$ ($I4_1/acd$) | 6.778 | 6.778 | 12.740 | 6.941 | 6.941 | 13.027 |
| o-$Cs_2C_2$ (Pnma) | 9.545 | 5.001 | 10.374 | 9.826 | 5.061 | 10.491 |
| h-$Cs_2C_2$ ($P\bar{6}2m$) | 8.637 | 8.637 | 5.574 | 8.728 | 8.728 | 6.048 |
| $CsAgC_2$ (P42mmc) | 5.247 | 5.247 | 8.528 | 5.317 | 5.317 | 9.036 |
| $Na_2PdC_2$ ($P\bar{3}m1$) | 4.464 | 4.464 | 5.266 | 4.632 | 4.632 | 5.284 |
| $Cs_2PdC_2$ ($P\bar{3}m1$) | 5.624 | 5.624 | 5.298 | 5.804 | 5.804 | 5.265 |
| $Na_2TeC_2$ ($P\bar{3}m1$) | — | — | — | 4.767 | 4.767 | 6.102 |
| $Cs_2TeC_2$ ($P\bar{3}m1$) | — | — | — | 5.820 | 5.820 | 6.152 |

TABLE I: Validation of the a, b and c lattice parameters on several test systems using the PBE density functional, as described in the discussion. Orthorhombic and hexagonal $Cs_2C_2$ are denoted as o-$Cs_2C_2$ and h-$Cs_2C_2$, respectively, with structural parameters not very accurately determined due to the coexistence of the two phases at any temperature.

| Compound, space-group & reference | d(C-C) EXPT (Å) | DFT (Å) | d(M-C) EXPT (Å) | DFT (Å) |
|---|---|---|---|---|
| C ($Fd\bar{3}m$) | 1.544 | 1.547 | — | — |
| $C_2H_2$ (gas) | 1.203 | 1.203 | — | — |
| $Na_2C_2$ ($I4_1/acd$) | 1.204 | 1.261 | — | — |
| o-$Cs_2C_2$ (Pnma) | 1.38 | 1.269 | — | — |
| h-$Cs_2C_2$ ($P\bar{6}2m$) | 0.934 | 1.267 | — | — |
| $CsAgC_2$ (P42mmc) | 1.216 | 1.249 | 2.016 | 2.034 |
| $Na_2PdC_2$ ($P\bar{3}m1$) | 1.262 | 1.271 | 2.019 | 2.006 |
| $Cs_2PdC_2$ ($P\bar{3}m1$) | 1.260 | 1.280 | 2.019 | 1.993 |
| $Na_2TeC_2$ ($P\bar{3}m1$) | — | 1.259 | — | 2.422 |
| $Cs_2TeC_2$ ($P\bar{3}m1$) | — | 1.257 | — | 2.452 |

TABLE II: Validation of C—C and M-C distances (M is transition-metal or metalloid element).

| Compound Surface | Φ(eV) EXPT | DFT | Eg(Γ) (eV) DFT | σ(eV/Å$^2$) DFT |
|---|---|---|---|---|
| Cs (100) | 2.14 | 2.00 | 0.29 | 0.005 |
| Te (001) | 4.95 | 5.02 | 0.54 | 0.036 |
| $Cs_2Te$ (001) | 2.90-3.0 | 3.08 | 0.77 | 0.015 |
| $Cs_2Te$ (010) | 2.90-3.0 | 2.90 | 1.04 | 0.014 |
| (Cs) $Na_3KSb$ | 1.55 | — | — | — |
| $K_2CsSb$ | 1.9-2.1 | — | — | — |

TABLE III: Experimental and calculated (DFT) properties of photoemissive surfaces of validation materials: workfunctions (Φ), bandgaps at the Γ-point Eg(Γ) and surface energies (σ).

| Compound and surface | Unrelaxed Φ (eV) | Eg(Γ) (eV) | σ (eV/Å$^2$) | relaxed Φ (eV) | Eg(Γ) (eV) | σ (eV/Å$^2$) |
|---|---|---|---|---|---|---|
| o-$Cs_2C_2$ (010) | 2.80 | 1.25 | 0.023 | — | — | — |
| h-$Cs_2C_2$ (001) | 2.56 | 1.14 | 0.027 | — | — | — |
| $Na_2PdC_2$ (001) | 3.58 | 1.13 | 0.067 | — | — | — |
| $Na_2PdC_2$ (110) | 3.73 | 1.65 | 0.029 | 4.17 | 2.34 | 0.024 |
| $Na_2PdC_2$ (010) | 2.65 | 1.91 | 0.019 | 2.68 | 2.45 | 0.017 |
| $Cs_2PdC_2$ (001) | 2.90 | 1.43 | 0.046 | — | — | — |
| $Cs_2PdC_2$ (110) | 2.73 | 0.88 | 0.026 | 2.73 | 1.16 | 0.022 |
| $Cs_2PdC_2$ (010) | 1.33 | 0.78 | 0.015 | 2.03 | 1.74 | 0.013 |
| $Na_2TeC_2$ (001) | 3.40 | 1.03 | 0.029 | — | — | — |
| $Na_2TeC_2$ (110) | 3.80 | 0.91 | 0.025 | 4.67 | 2.04 | 0.009 |
| $Na_2TeC_2$ (010) | 2.75 | 1.43 | 0.015 | 2.68 | 1.34 | 0.015 |
| $Cs_2TeC_2$ (001) | 3.71 | 1.86 | 0.022 | — | — | — |
| $Cs_2TeC_2$ (110) | 2.77 | 0.77 | 0.020 | 2.98 | 1.38 | 0.019 |
| $Cs_2TeC_2$ (010) | 1.71 | 1.00 | 0.013 | 2.44 | 1.63 | 0.009 |

TABLE IV: Calculated (DFT) properties of photoemissive surfaces of acetylide compounds: workfunctions (Φ), bandgaps at the Γ-point Eg(Γ) and surface energies (σ). Relaxed slabs refer to the relaxation of unrelaxed ones with the central 2 layers fixed. For h-$Cs_2C_2$(001) and $Na_2TeC_2$(010), Eg(Γ)≈0.05 eV has been found for a single band above EF as well.

Thus, anomalous anisotropy of workfunction values in ternary alkali metal transition metal acetylides has been reported. Workfunction values of some characteristic surfaces in these emerging semiconducting materials may differ by more than ≈2 eV as predicted by Density Functional Theory calculations. This large anisotropy is a consequence of the relative orientation of rod-like $[MC2]_\infty$ negatively charged polymeric subunits and the surfaces, with M being a transition metal or metalloid element and C2 refers to the acetylide ion $C_2^{2-}$, with the rods embedded into an alkali cation matrix. It is shown that the conversion of the seasoned $Cs_2Te$ photo-emissive material to ternary acetylide $Cs_2TeC_2$ results in substantial reduction of its ≈3 eV workfunction down to 1.71-2.44 eV on the $Cs_2TeC_2$(010) surface while its high quantum yield is preserved. Similar low workfunction values are predicted for other ternary acetylides as well, allowing for a broad range of applications from improved electron- and light-sources to solar cells, field emission displays, detectors and scanners.

Electrode

In an exemplary embodiment, an electrode is made of an electrically conductive material including a photoemissive compound based on the descriptions herein. The electrode replenishes the electrons emitted by the photoemissive compound. Preferably, the electrode is made out of a metal, preferably Copper (Cu). In another embodiment, the electrode is made out of graphite or semiconducting materials, such as silicon.

Photoemissive Chemical Compound

As described herein, the photoemissive material includes $A_nMC_2$, where A is a first metal element; n is an integer that is 0, 1, 2, 3 or 4; M is a second metal element; and $C_2$ is a reference to the acetylide ion $C_2^{2-}$.

The first element, A, is preferably an alkali metal, and alkaline-earth element or Aluminum (Al). In some exemplary embodiments, the first element, A, is an alkali metal. The alkali metals are Lithium (Li), Sodium (Na), Potassium (K), Rubidium (Rb), Cesium (Cs) and Francium (Fr). The alkaline-earth elements are Beryllium (Be), Magnesium (Mg), Calcium (Ca), Strontium (Sr), Barium (Ba), and Radium (Ra). Of these Na, K, Rb, and Cs are preferred.

The second element, M, is a transition metal or a metal stand-in. In an exemplary embodiment, M is a transition metal that is any element in groups 3 through 12 inclusive on the Periodic Table of Elements (Sc, Ti, V, Cr, Mn, Fe, Co, Ni, Cu, Zn, Y, Zr, Nb, Mo, Tc, Ru, Rh, Pd, Ag, Cd, La and the lanthanides (57-70), Hf, Ta, W, Re, Os, Ir, Pt, Au, Hg, Ac and the actinide (89-112)). In another exemplary embodiment, M is a metal stand-in element selected from the following group of elements: Tellurium (Te), Selenium (Se), Arsenic (As), Antimony (Sb), Bismuth (Bi), Carbon (C), Silicon (Si), Germanium (Ge), Tin (Sn), Lead (Pb), Boron (B), Aluminum (Al), Gallium (Ga), Indium (In), and Thallium (Tl). In some preferred embodiments, the second element, M, is Palladium (Pa), Platinum (Pt), Gold (Au), Silver (Ag), Copper (Cu), Nickel (Ni), Iron (Fe) or Tellurium (Te).

"n" is chosen so that the resulting material of the photoemissive compound is charge neutral. In some exemplary embodiments, "n" is preferably 1; for example, $NaCuC_2$. In other exemplary embodiments, "n" is preferably 2; for example $Cs_2PdC_2$. Most preferably n is 2.

Crystalline Structure of the Photoemissive Material

The photoemissive material has a crystalline structure including rod-like 1-dimensional polymeric chains with $MC_2$ repeating units embedded in a matrix of A. Within the polymeric chains, M-C, C—C and C-M bonds alternate along a line. Examples of such materials and structures can be found in U. Ruschewitz, Z. Anorg. Allg. Chem. 2006, 632, 705-719, hereby fully incorporated by reference. The crystalline surfaces are (001), (010), (100) and (110).

Crystallographic Surface

The crystallographically oriented surface of the photoemissive material is the cleavage plane of the crystal with respect to the crystal's own crystallographic axes. The crystallographic surfaces are defined by their Miller indices. For example $Cs_2PdC_2$ has a hexagonal lattice with the rod-like 1-dimensional polymeric substructures of $PdC_2$ repeating units running parallel with the main crystallographic axis. In the exemplary embodiments including a material of the photoemissive compound of $Cs_2PdC_2$ the preferred crystallographic surface is (010), which should exhibit an ultra-low 1.33 eV workfunction value.

The material of the photoemissive compound has properties that are preferably tailored to specific applications. The surface properties of the material are highly anisotropic for its different crystallographic surfaces. Because of the highly anisotropic nature of the chemical composition, these properties can change depending on the crystallographic surface. These properties include workfunction, photo-yield (emitted electrons produced per incident photons) and surface formation energy. Some crystallographic surfaces of interest include, but are not limited to, (100), (001), (010) and (110). The photoemissive properties of materials can be predicted by quantum-chemistry, which is a reliable theoretical/computational tool to predict properties of materials on a qualitative or often quantitative level of accuracy, without carrying out experiments. Such a quantum-chemical methodology to predict photoemissive properties has been described.

In an exemplary embodiment, the material of the photoemissive compound includes $Cs_2MC_2$, or $Rb_2MC_2$, with M being a transition metal or Te, using the (010) crystallographic surface. This selection of materials and surfaces provides ultra-low workfunctions combined with high photo-yields and long operational lifetimes.

In another exemplary embodiment, a photocathode where the photoemissive material is based on the chemical composition $Cs_2TeC_2$. $Cs_2TeC_2$ is preferably created by reacting crystalline $Cs_2Te$ with gaseous acetylene —$C_2H_2$. Alternatively, $Cs_2TeC_2$ is preferably created by reacting crystalline $Cs_2C_2$ with crystalline Te. The various crystallographic surfaces of $Cs_2TeC_2$ change the material's properties, most notably its workfunction. For example, a photocathode where the photoemissive compound includes $Cs_2TeC_2$ with (010) surface would become photoemissive when exposed to wavelengths of light down to the infrared spectrum with photon energy of approximately 1.7-2.4 eV and above. Other crystallographic surfaces of $Cs_2TeC_2$ provide different workfunction. For example, $Cs_2TeC_2$(110) has a workfunction of 2.37 eV, and $Cs_2TeC_2$(001) has a workfunction of 3.31 eV.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure and are intended to be covered by the following claims.

What is claimed is:

1. A photocathode, comprising:

an electrode; and a photoemissive material coating at least part of the electrode, wherein the photoemissive material comprises $A_nMC_2$, where A is a first metal element; n is an integer from the group of integers consisting of 0, 1, 2, 3 and 4; M is a second metal element; and $C_2$ is triple bond carbon, in the form of $C_2^{2-}$ as an acetylide ion;

wherein the photoemissive material comprises a crystalline structure or non-crystalline structure of rod-like or curvy 1-dimensional polymeric substructures with $MC_2$ repeating units embedded in a matrix of A; and wherein the crystalline photoemissive material comprises a crystallographic surface.

2. The photocathode of claim 1, wherein the first element is an alkali metal, an alkaline-earth element or the element Al.

3. The photocathode of claim 1, wherein the second element is a transition metal or a metal stand-in.

4. The photocathode of claim 3, wherein the transition metal is selected from any element in groups 3 through 12 inclusive on the Periodic Table of Elements (Sc, Ti, V, Cr, Mn, Fe, Co, Ni, Cu, Zn, Y, Zr, Nb, Mo, Tc, Ru, Rh, Pd, Ag, Cd, La and the lanthanides (57-70), Hf, Ta, W, Re, Os, Ir, Pt, Au, Hg, Ac and the actinide (89-112)).

5. The photocathode of claim 3, wherein the metal stand-in is chosen from a group consisting of Ag, Au, Cu, Ni, Fe, Pd, Pt, and Te.

6. The photocathode of claim 3, wherein the crystallographic surface is (010).

7. The photocathode of claim 1, wherein the photoemissive material is $Rb_2MC_2$; wherein the second element M is chosen from a group of elements comprising the transition metals and Te.

8. The photocathode of claim 1, wherein the photoemissive material is $Cs_2MC_2$; wherein the second element M is chosen from a group of elements comprising the transition metals and Te.

9. The photocathode of claim 8, wherein the photoemissive material is $Cs_2TeC_2$.

10. The photocathode of claim 9, wherein the crystallographic surface is (001).

11. The photocathode of claim 9, wherein the crystallographic surface is (010).

12. The photocathode of claim 9, wherein the crystallographic surface is (110).

13. The photocathode of claim 9, wherein the crystallographic surface is (100).

14. The photocathode of claim 8, wherein the photoemissive material is $Cs_2PdC_2$.

15. The photocathode of claim 1, wherein the photoemissive material is $Na_2MC_2$; wherein the second element M is chosen from a group of elements comprising the transition metals and Te.

16. The photocathode of claim 15, wherein the photoemissive material is $Na_2PdC_2$.

17. The photocathode of claim 15, wherein the photoemissive material is $Na_2TeC_2$.

18. The photocathode of claim 1, wherein the first metal is Na, K, Rb, or Cs.

19. A photoemissive material for coating at least part of an electrode, comprising:

$A_nMC_2$, where A is a first metal element; n is an integer from the group of integers consisting of 0, 1, 2, 3 and 4; M is a second metal element; and $C_2$ is triple bond carbon, in the form of $C_2^{2-}$ as an acetylide ion;

wherein the photoemissive material comprises a crystalline structure or non-crystalline structure of rod-like or curvy 1-dimensional polymeric substructures with $MC_2$ repeating units embedded in a matrix of A; and wherein the crystalline photoemissive material comprises a crystallographic surface.

20. A low-workfunction photocathode, comprising:

an electrode;

a photoemissive material coating at least part of the electrode, wherein the photoemissive material comprises $Cs_2TeC_2$;

wherein the photoemissive material comprises a crystalline structure or non-crystalline structure of rod-like or curvy 1-dimensional polymeric substructures with $TeC_2$ repeating units embedded in a matrix of $Cs_2$; and wherein the crystalline photoemissive material comprises a crystallographic surface.

* * * * *